US011404839B2

(12) United States Patent
Frenken

(10) Patent No.: US 11,404,839 B2
(45) Date of Patent: Aug. 2, 2022

(54) CRIMPING PLIERS

(71) Applicant: GUSTAV KLAUKE GMBH, Remscheid (DE)

(72) Inventor: Egbert Frenken, Heinsberg (DE)

(73) Assignee: GUSTAV KLAUKE GMBH, Remscheid (DE)

( * ) Notice: Subject to any disclaimer, the term of this patent is extended or adjusted under 35 U.S.C. 154(b) by 98 days.

(21) Appl. No.: 17/056,063

(22) PCT Filed: May 3, 2019

(86) PCT No.: PCT/EP2019/061377

§ 371 (c)(1),
(2) Date: Nov. 17, 2020

(87) PCT Pub. No.: WO2019/219407

PCT Pub. Date: Nov. 21, 2019

(65) Prior Publication Data

US 2021/0296837 A1 Sep. 23, 2021

(30) Foreign Application Priority Data

May 17, 2018 (DE) ..... 10 2018 111 873.2

(51) Int. Cl.
*H01R 43/042* (2006.01)
*B25B 27/14* (2006.01)

(52) U.S. Cl.
CPC ..... *H01R 43/042* (2013.01); *B25B 27/146* (2013.01); *Y10T 29/53222* (2015.01)

(58) Field of Classification Search
CPC ..... H01R 43/042; H01R 43/0421; H01R 43/0428; B25B 7/04; B25B 7/12; B25B 7/123; B25B 7/14; B25B 7/16; B25B 27/146; Y10T 29/53222
See application file for complete search history.

(56) References Cited

U.S. PATENT DOCUMENTS 5,802,908 A 9/1998 Frenken

FOREIGN PATENT DOCUMENTS

| | | | |
|---|---|---|---|
| DE | 8029841 | U1 | 2/1981 |
| DE | 19628752 | A1 | 1/1998 |
| WO | 2016/096732 | A2 | 6/2016 |

OTHER PUBLICATIONS

International Search Report for International Patent Application No. PCT/EP2019/061377 dated Jul. 18, 2019, 4 pages.
International Preliminary Examination Report for International Patent Application No. PCT/EP2019/061377, dated Jul. 29, 2020, 12 pages.
Machine translation of DE 8029841 U1.
Machine translation of DE 19628752 A1.
Machine translation of WO 2016/096732 A2.

*Primary Examiner* — Peter Dungba Vo
*Assistant Examiner* — Joshua D Anderson
(74) *Attorney, Agent, or Firm* — Klintworth & Rozenblat IP LLP

(57) ABSTRACT

Crimping pliers for pressing cable shoes or the like onto electrical conductors, have two crimping jaws which can be pivoted towards each other, a crimping die being mounted rotatably in each crimping jaw, the crimping die being formed with multiple different crimping depressions over a circumference in relation to a rotation axis, and a crimping die held between two jaw plates in relation to the rotation axis. The crimping dies can be shifted relative to the jaw plates into a clamping position and a release position when the crimping pliers are assembled ready for use.

19 Claims, 11 Drawing Sheets

23
31
25
12
a
15
43
45
y
17
25
23
2
11
16
31
43
45
y
48
50
12

Fig:7
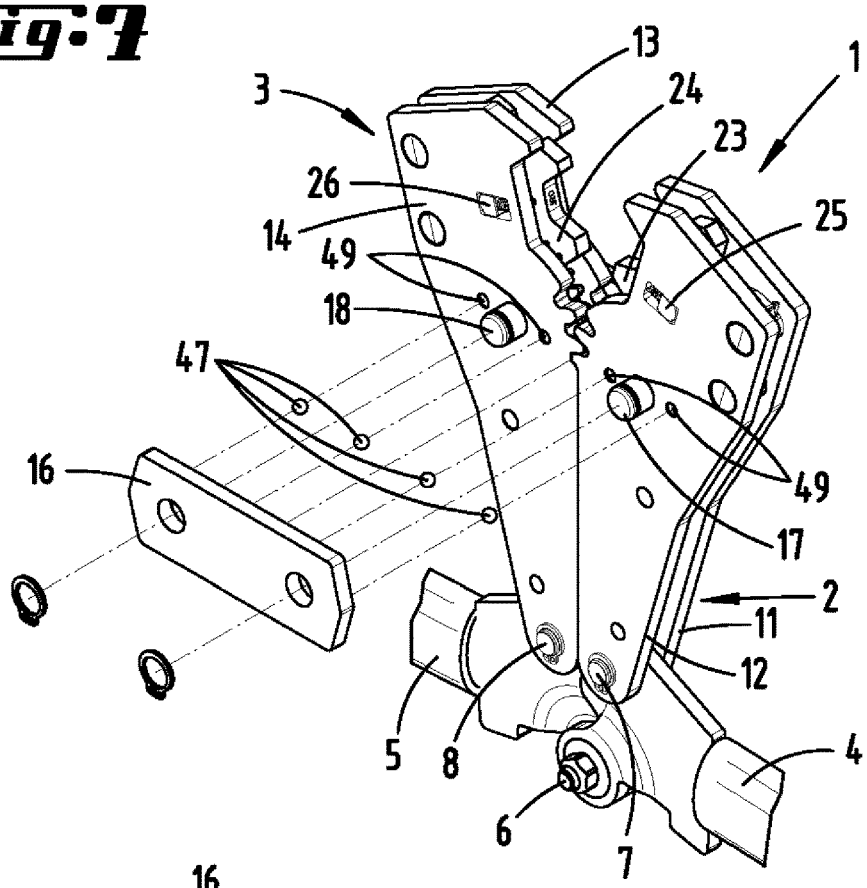
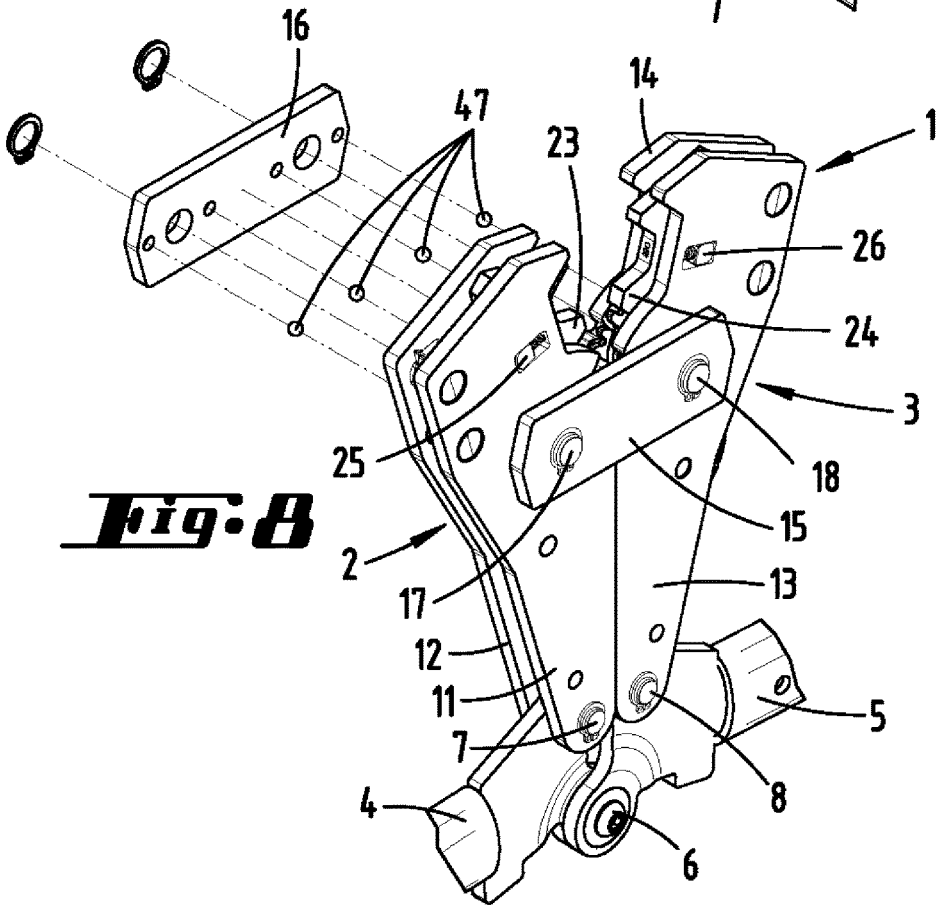
Fig:8

CRIMPING PLIERS

The invention relates to crimping pliers, in particular for pressing cable shoes or the like onto electrical conductors, having two crimping jaws that can be pivoted toward one another, wherein a respective crimping die formed with multiple different crimping depressions over a circumference in relation to a rotational axis is rotatably mounted in each crimping jaw, and a crimping die is held between two jaw plates in relation to the rotational axis.

PRIOR ART

Crimping pliers of the kind in question are known, both as hand-operated and motor-driven tools. For example, the latter are used to fasten cable shoes on electrical conductors. To this end, an in particular tubular workpiece is crimped between the two crimping jaws, for example with hexagonal crimping depressions. As a rule, each cable cross section here requires a different crimping profile, i.e., a different opening cross section of the crimping depressions of both crimping dies. In known pliers, the crimping dies are correspondingly adjusted by rotationally displacing the crimping dies around their rotational axes, wherein the crimping depressions of both crimping dies must be synchronized for properly crimping the workpiece.

Known from DE 8029841 U1 are crimping pliers, which are acted upon by means of a leaf spring transverse to a rotational axis of the scrimping dies, wherein the crimping dies can also be adjusted under exposure to the leaf spring.

Known from DE 19628752 A1 are conventional crimping pliers assembled ready for use, in which the axes passing through the crimping dies and jaw plate are screwed together, and the crimping dies can be adjusted.

SUMMARY OF THE INVENTION

As concerns the prior art described above, the invention deals with the task of further improving crimping pliers of the kind in question, in particular with respect to the crimping result on the workpiece.

This task is resolved in the subject matter of claim 1, in which the aim is to have the crimping dies be movable relative to the jaw plates in a clamping direction and a release position that enables an adjustment, at any rate in an open position of the crimping jaws in which a clamping is lifted, given crimping pliers that are assembled ready for use, wherein clamping the jaw plates in the clamping position results in a fixation of the crimping dies in the direction of the rotational axis, and the clamping is generated automatically during the conventional use of the crimping pliers.

Free rotational movability is required to allow for the rotational displaceability of the crimping dies relative to the jaw plates flanking them. In the known crimping jaw solutions, this is provided by a free axial play of the crimping die between the jaw plates. The crimping die is correspondingly arranged so that it can move between the jaw plates in the direction of its rotational axis by an amount preferably measuring a few tenths of a millimeter. However, at the moment a cable shoe or the like is crimped, this minimal axial play required for the rotational displaceability of the crimping die can lead to a shifting of the interacting crimping dies, in particular their crimping depressions, in the direction of their rotational axes, correspondingly by an offset that corresponds up to the measure of the axial play. Even if a proper crimping was performed overall, the resultant axial displacement of the crimping geometries can at least optically create an opposite impression on the workpiece, here the cable shoe.

This disadvantage is countered by the proposed solution. The crimping dies can be fixed in place by clamping. This fixation takes place at least in the crimping position of the crimping pliers, further preferably over a large pivot angle of the crimping jaws as far as into nearly any pivoting position of the crimping jaws outside of an open position of the crimping jaws. The axial play arising in the crimping jaw open position is lifted. Crimping brings about a clamping position of the crimping dies between the jaw plates, between which the (respective) crimping die is received. The crimping dies are in a release position that enables an adjustment, at any rate in the open position of the crimping jaws, the open position of the crimping pliers.

In a preferred embodiment, a rotational displacement of the crimping dies for setting the crimping depression alignment can be performed solely in the open position of the crimping jaws, further preferably in an open position in which the crimping depressions of the crimping dies are arranged as far apart from each other as possible owing to the crimping jaws having been pivoted open. In this crimping jaw open position, the clamping can be lifted, and the release position can be correspondingly given relative to the crimping die. In this release position, the axial play necessary for the rotational displacement of the crimping die can be present.

In this way, the crimping dies can be fixed in a strict opposing alignment while pivoting the crimping jaws in the direction toward the crimping position, even though these crimping dies are nevertheless freely rotatable with the crimping jaws open.

In the clamped position, clamping the jaw plates makes it possible to fix the crimping dies in the direction of the rotational axis.

In the clamped position, clamping the jaw plates results in the crimping dies being fixed in the direction of the rotational axis.

In a preferred embodiment, the jaw plates of the opposing crimping jaws can interact with a shared connection piece. The connection piece can here offer the rotational axis for the crimping jaw or the pair of jaw plates to form a crimping jaw. The jaw plates of both crimping jaws allocated to a connection piece are each hinged to the shared connection piece so as to be pivotable around a rotational axis. This yields a relative movement between the jaw plates and connection piece.

This relative movement can be used to produce the clamping.

Depending on a rotational displacement of the crimping jaw plates relative to the otherwise fixed connection piece, the clamping of the jaw plates of a crimping jaw is generated accordingly or lifted given an opposite rotational displacement.

Accordingly, no additional measures by the user of the crimping pliers are required in a preferred embodiment for fixing the crimping die in place by clamping the jaw plates. Rather, the clamping of the jaw plates that fixes the crimping die in place is preferably generated automatically during the conventional use of the crimping pliers, i.e., during a conventional pivoting displacement of the crimping jaws in the direction toward the crimping position.

In a preferred embodiment, one of the parts, the connection piece or the jaw plate, can have an elevation in the direction of the rotational axis, and the other part can have a recess adjusted to the elevation. A surface can be formed on the respective part outside of the recess, correspondingly preferably surrounding the latter. This surface can simultaneously form a separating plane transverse to the rotational axis between the connection piece and the facing jaw plate.

An imagined elongated extension of the surface until into the area of the recess, correspondingly an imagined surface elongation that spans or passes through the recess, can be passed through by the elevation with the jaw plates in the unclamped state (release position). The elevation can correspondingly be enclosed in the recess or engage into the latter.

This can correspondingly yield a complete or only partial engagement by the elevation into the facing recess in the open position of the crimping jaws, where an axial play arises in this open position to allow the rotational displacement of the crimping die.

In another possible embodiment, both parts, specifically preferably the connection piece and the facing jaw plates, can have an elevation that protrudes over the surface facing the respectively opposing part in the axial direction. The two elevations of both parts can interact in order to reach the clamping position.

A surface that touches a first elevation and runs parallel to a pivoting plane of the parts, for example a free contact surface of the elevation that faces in the direction toward the other part, can pass through the elevation of the other part in the release position in an imagined elongation of this (support) surface in the pivoting direction of the parts. In the release position, the two elevations can further at least partially overlap each other as viewed in the pivoting direction.

This overlap can be completely lifted in the clamping position. Alternatively, however, a partial overlap in the pivoting direction can be given even in this clamping position, but with an overlap viewed perpendicular to the geometric rotational axis that is smaller than the overlap in the release position.

In the clamped state or in the clamping position, the elevation can have completed a relative movement in the direction toward the imagined elongated extension of the surface in the area of the recess or beyond it. In a preferred embodiment, the elevation can completely leave the area of the recess during the pivoting displacement of the crimping jaw out of the open position in the direction toward the crimping position, after which the elevation is supported on the surface of the part surrounding the recess. As also preferred, this can lead to a compressive stress on the jaw plates having the recess or the elevation, wherein this compressive stress acts essentially in the direction of the rotational axis alignment. The elastic deformation of the jaw plate with the recess or the elevation causes the axial play of the allocated crimping die to be lifted during exposure to this compressive stress. The jaw plate exposed to compressive stress acts in an axial direction directly on the crimping die, or for example a hub or the like that carries the crimping die, so as to correspondingly clamp the crimping die between the two jaw plates.

This clamping is lifted in the crimping jaw position, in which the elevation again plunges into the recess, accompanied by a lifting of the compressive stress described above on the jaw plate in the axial direction. The latter can automatically rebuild in a base position due to the elastic properties of the jaw plate material.

The elevation can be spherical in design in a cross section in which the rotational axis is represented as a line. A contour of the elevation that arises in this cross section and faces in the direction of the other part can be imaged as a circular segment, for example as a semicircle.

In another possible embodiment, the elevation can be formed by a ball captured on the respective part. The ball can possibly be freely rotatably mounted in the respective part, for example while being received in a correspondingly shaped, pan-like recess.

The elevation can also be wedge-shaped in a cross section, correspondingly with a run-on bevel, for interacting with an area of the recess provided in the other part or a counter-wedge formed on the other part.

BRIEF DESCRIPTION OF THE DRAWINGS

The invention is described below based on the attached drawing, although the latter only illustrates exemplary embodiments. A part that was only explained relative to one of the exemplary embodiments and not replaced by another part in an additional exemplary embodiment based on the feature highlighted therein is thus in any event also described as a possible, present part even for this additional exemplary embodiment. The drawing shows:

FIG. 7 a partially exploded perspective of the crimping pliers in the open position of the crimping jaw;

FIG. 8 another partially exploded view of the crimping pliers according to FIG. 7;

DESCRIPTION OF THE EMBODIMENTS

Figure 1:
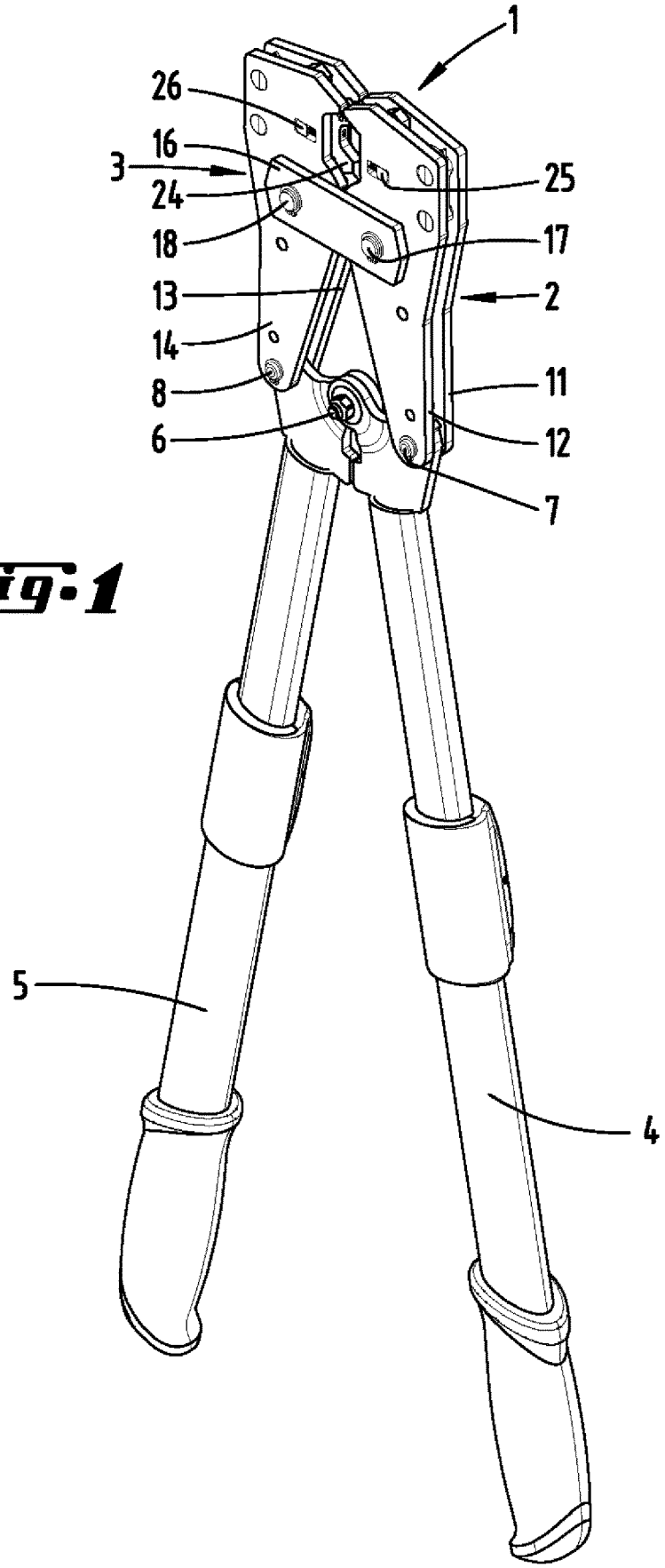
FIG. 1 a perspective view of hand-operated crimping pliers, crimping jaw in a closed position.

Initially depicted and described with reference to FIG. 1 are hand-operated crimping pliers 1 in a top view showing a working position, i.e., a crimping position. The crimping pliers 1 are essentially built up symmetrically to an axis x-x, and have two crimping jaws 2, 3, and two handles 4, 5 designed as angle levers. The latter are connected with each other at their angled ends by a joint pin 6 arranged on the axis of symmetry x-x.

The free end areas of the crimping jaws 2, 3 are hinged to the handles 4, 5 on both sides of the joint pin 6, wherein bolts that pass through the crimping jaws 2, 3 and the handles 4, 5 are provided, and secured with spring rings 9, 10.

The crimping jaws 2, 3 are essentially inversely identically designed relative to the axis x-x, and each consists initially of two jaw plates 11, 12 and 13, 14 spaced apart from each other in the axial direction of the bolts 7, 8 as well as of the joint pin 6. Bolt-side end areas of the handles 4, 5 can engage into the clearance space between the jaw plates 11, 12 or 13, 14.

The crimping jaws 2, 3 are preferably connected both on the upper and lower side, correspondingly of the respective outwardly facing flat side of the jaw plates, by connection pieces 15, 16, which in turn are interconnected by the axle bolts 17, 18 that pass through the crimping jaws 2, 3. In particular, a connection piece can be provided on only one side, opposite which a rivet head is formed, for example on an axle bolt.

The geometric axes of the bolts 7, 8 of the joint pin 6 as well as the axle bolts 17, 18 are aligned transverse to the axis x-x and perpendicular to a planar extension of the crimping jaws 2, 3 relative to their broadsides.

The rotational axes of the crimping jaws 2, 3 are formed by the axle bolts 17, 18, as a result of which the crimping jaws 2, 3 are divided into short front lever arms 19, 20 and longer rear lever arms 21, 22 facing the pivot bolts 7, 8.

A pivoting plane E of the jaw plates relative to the connection pieces arises transversely to the geometric axes of the axle bolts 17, 18.

A respective crimping die 23, 24 is rotatably mounted on an axis 25, 26 in the front, short lever arms 19, 20 of the crimping jaws 2, 3. The axes 25, 26 each pass through both jaw plates of the crimping jaws 2, 3, and are secured on either side, for example by a screw connection. The geometric rotational axis of the crimping dies is labeled y.

The crimping dies 23, 24 have the layout of an even-numbered polygon. In the exemplary embodiment shown, the crimping dies 23, 24 are designed with the layout of a regular hexagon.

Generally disk-like in design, the crimping dies 23, 24 have crimping depressions 27, 28 with varying opening cross sections on the periphery, each allocated to a lateral surface of the preferred hexagon.

Figure 2:
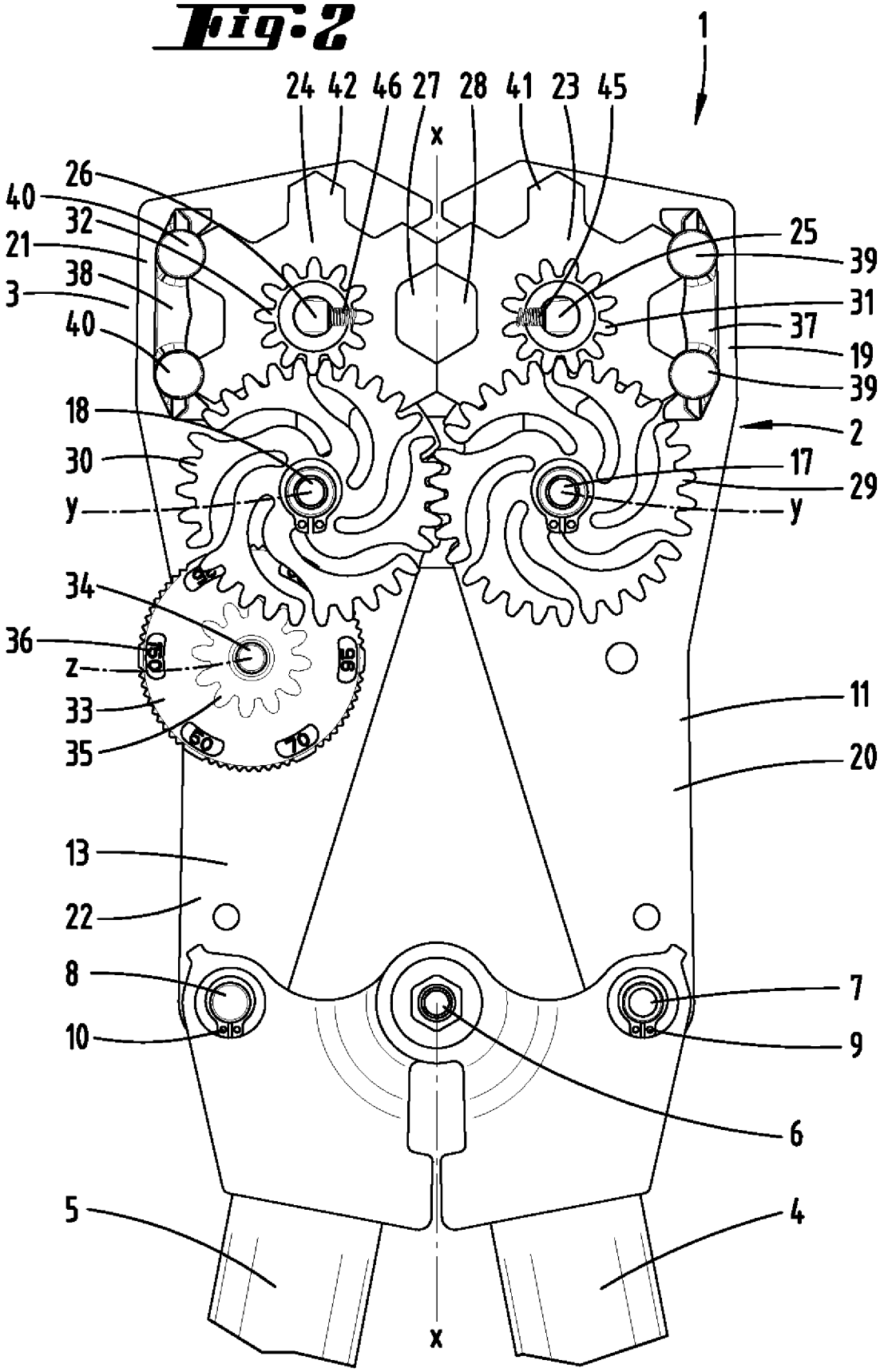
FIG. 2 a magnified elevation view of the crimping pliers, leaving away the front jaw plates and a connection piece, to provide a clear view of the of the crimping dies and a gearbox acting on the crimping dies, crimping jaw in the closed position.

In a top view, for example according to FIG. 2, the crimping depressions 27, 28 exhibit the shape of half an equilateral hexagon. In the working position, i.e., in the crimping position according to FIGS. 1, 2 and 9 to 12, a respective two crimping depressions 27, 28 with the same opening cross section together form a regular hexagon for pressing cable shoes, connectors or the like onto electrical conductors, etc.

In order to properly crimp a cable shoe or the like, crimping depressions 27, 28 of the same size as adjusted to the crimping process are to be moved into the working position. This is done by turning the crimping dies 23, 24 around the axes 25, 26.

A crimping die 23, 24 is provided with an accompanying output wheel 31, 32 non-rotatably connected thereto in the direction of the rotational axis y, each arranged side by side. The output wheel 31, 32 and crimping die 23, 24 essentially extend in the space bordered by the jaw plates 11 and 12 or 13 and 14.

An axial play here arises to enable the rotatability of the crimping dies 23 and 24, in particular in the open position of the crimping pliers. In particular in the open position of the crimping pliers, a corresponding distance a remains, resulting from the fact that the clear distance of the facing interior surfaces of two jaw plates 11 and 12 or 13 and 14 forming a crimping jaw 2 or 3 as viewed in the direction of extension of the rotational axis y is larger than the sum of the thicknesses of the output wheel 31, 32 and crimping die 23, 24, likewise as viewed in the direction of the rotational axis y. A position in which the mentioned distance is given is referred to as the release position.

In the illustrations, this remaining distance a is exaggeratedly shown to provide a better explanation. In reality, the distance a measures a few tenths of a millimeter, for example up to 3 tenths of a millimeter or even up to about 2 tenths of a millimeter.

To prevent the crimping dies 23 and 24 from not precisely aligning with each other as viewed transversely to the direction of the rotational axis y, specifically from possibly being able to have an offset on the order of magnitude of distance a, this axial play is practically no longer given in the crimping position of the crimping pliers.

In order to achieve this, the crimping dies 23 and 24 are fixed in place in the crimping position of the crimping pliers. This fixation takes place by clamping the jaw plates 11, 12 or 13, 14 flanking the crimping die 23 or 24 in the direction of the rotational axis y. The crimping jaws are thus at any rate in the clamped position in the crimping position of the crimping pliers.

This clamping is achieved by a relative movement between one of the connection pieces 15, 16, in the exemplary embodiment shown the connection piece 16, and the jaw plate 12 or 14 that immediately follows in the direction of the rotational axis y.

Figure 3:
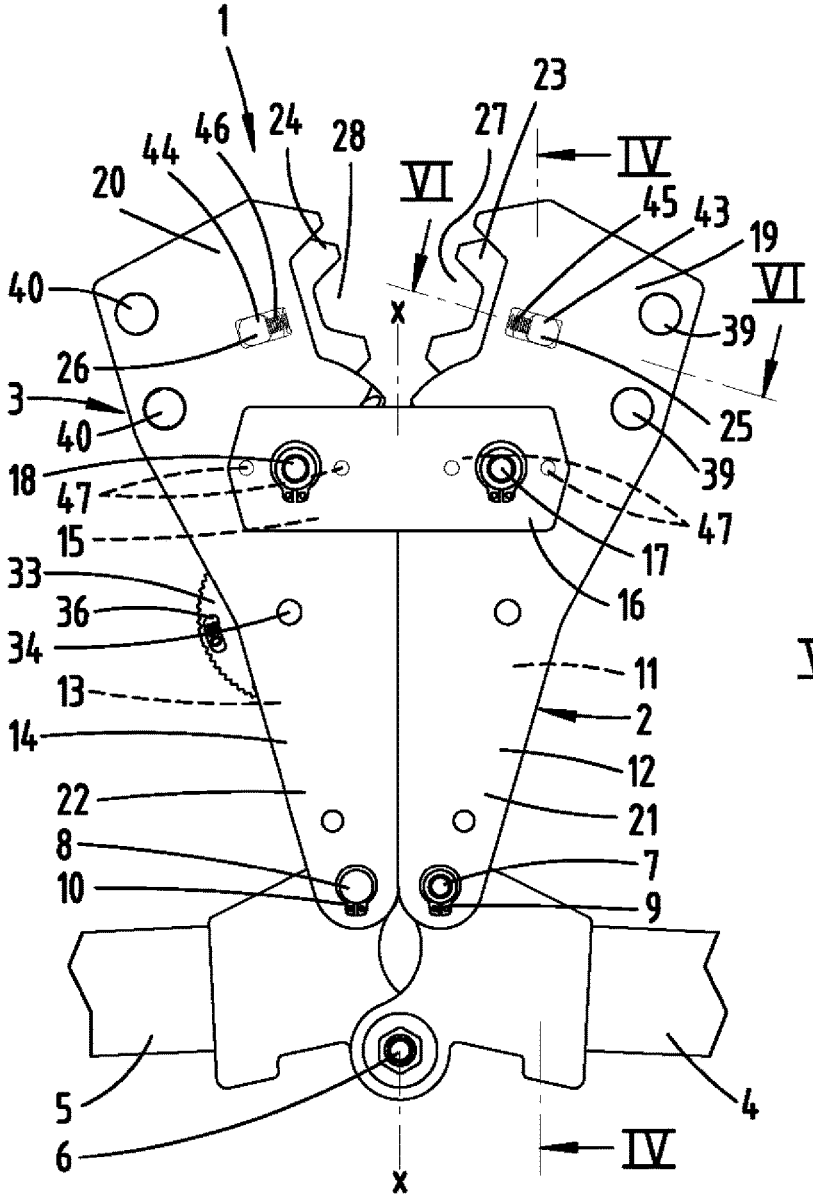
FIG. 3 the magnified elevation view of the crimping pliers, crimping jaw in an open position.
Figure 4:
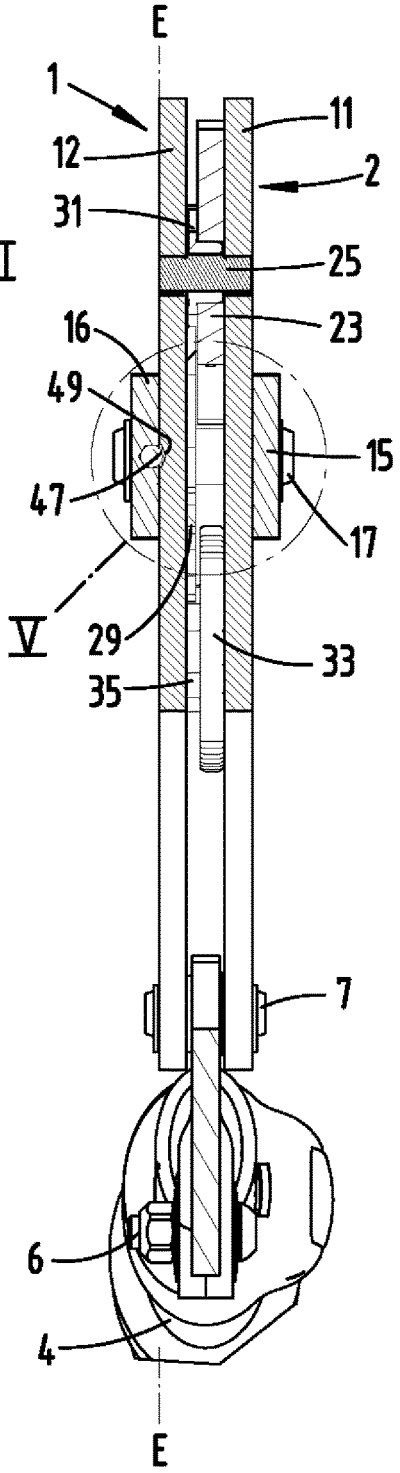
FIG. 4 the section according to line IV-IV on FIG. 3.

As continuously reflected upon here, a switch between the release position and the clamping position given crimping pliers assembled ready for use preferably takes place with each switch between the crimping position of the crimping pliers (e.g., see FIG. 2) and the open position of the crimping pliers (e.g., see FIG. 3).

To this end, one of the parts interacting in this regard, specifically the jaw plate 12 or 14 or the connection piece 16, has an elevation 47 that faces in the direction toward the other part.

Figure 11:
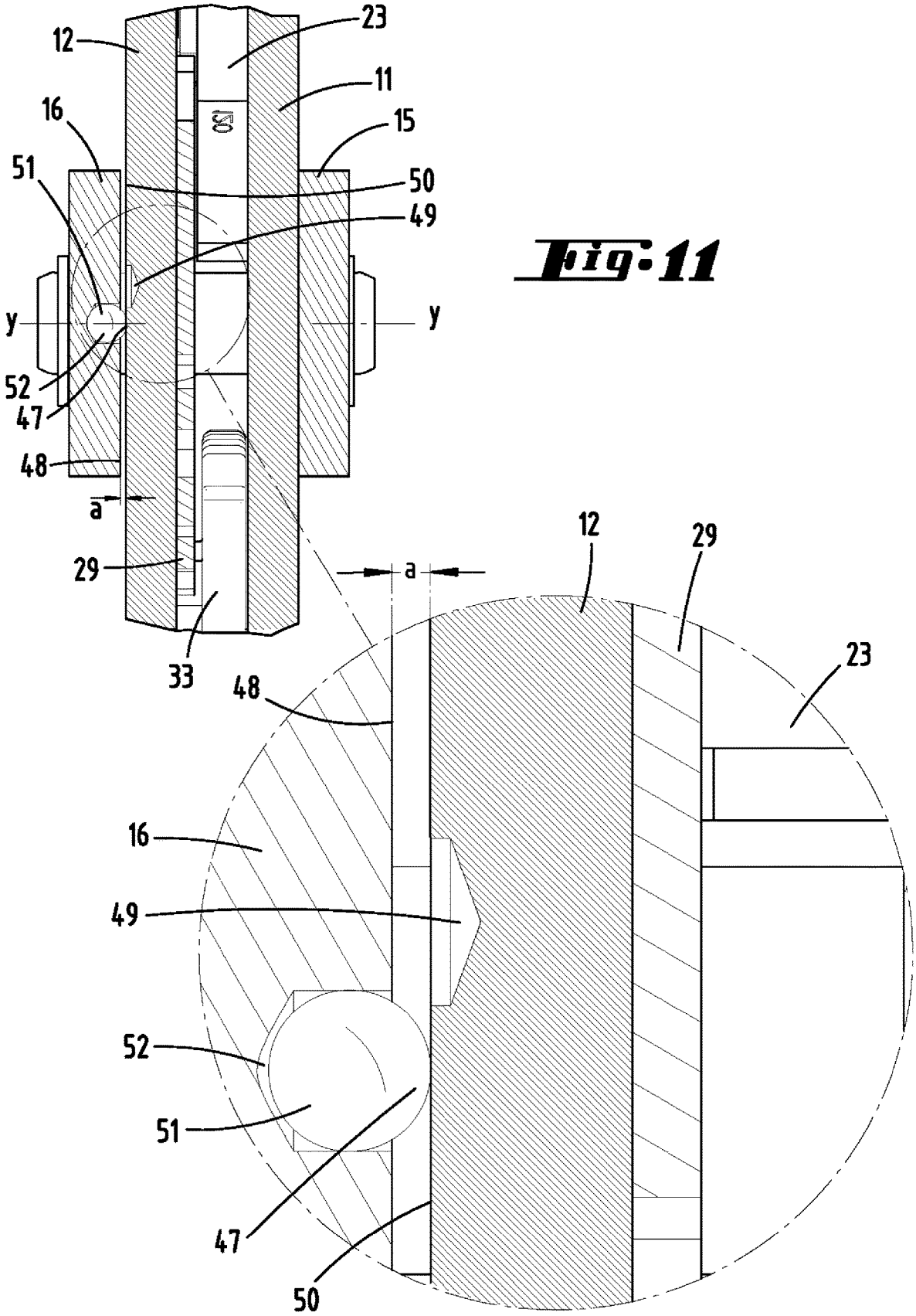
FIG. 11 the magnification with focus on area XI on FIG. 10, with accompanying loupe-like magnified view.
Figure 12:
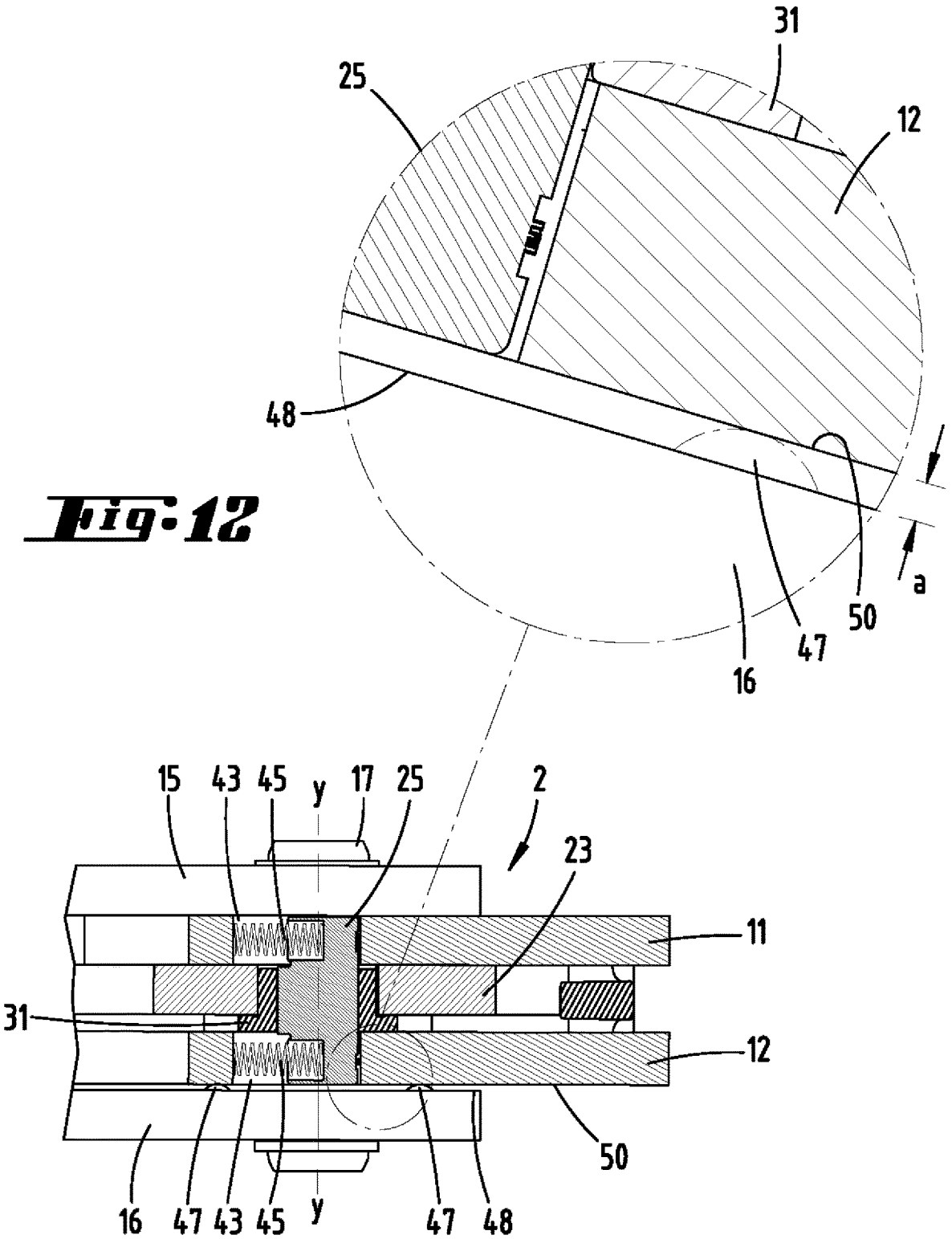
FIG. 12 the section according to line XII-XII on FIG. 9, with accompanying loupe-like magnified view.
Figure 13:
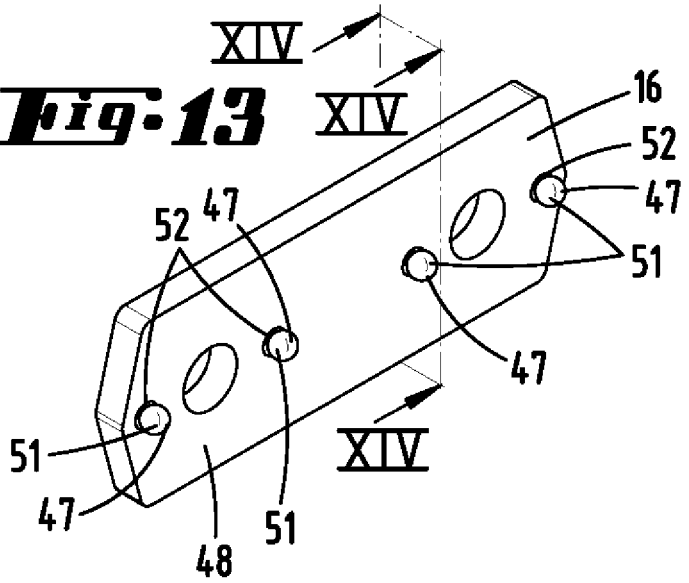
FIG. 13 a perspective, individual view of a connection piece with allocated elevations in the form of balls.

In the exemplary embodiments shown, the elevation 47 is formed on the connection piece 16, wherein the elevation 47 protrudes over the surface 48 of the connection piece 16 facing the jaw plate 12 or 14 in the direction of the rotational axis y, for example as exemplarily shown on FIG. 11, by a measure corresponding to the clearance a for the axial play.

In the open position of the crimping pliers, the elevation 47 protruding over the surface 48 of the connection piece 16 plunges into an allocated and adjusted recess 49 of the other part, here the jaw plate 12 or 14. The recess 49 is open to the surface 50 of the jaw plate 12 or 14 that faces the connection piece 16, and has a depth as viewed in the direction of the rotational axis y that permits the complete accommodation of the elevation 47.

Figure 5:
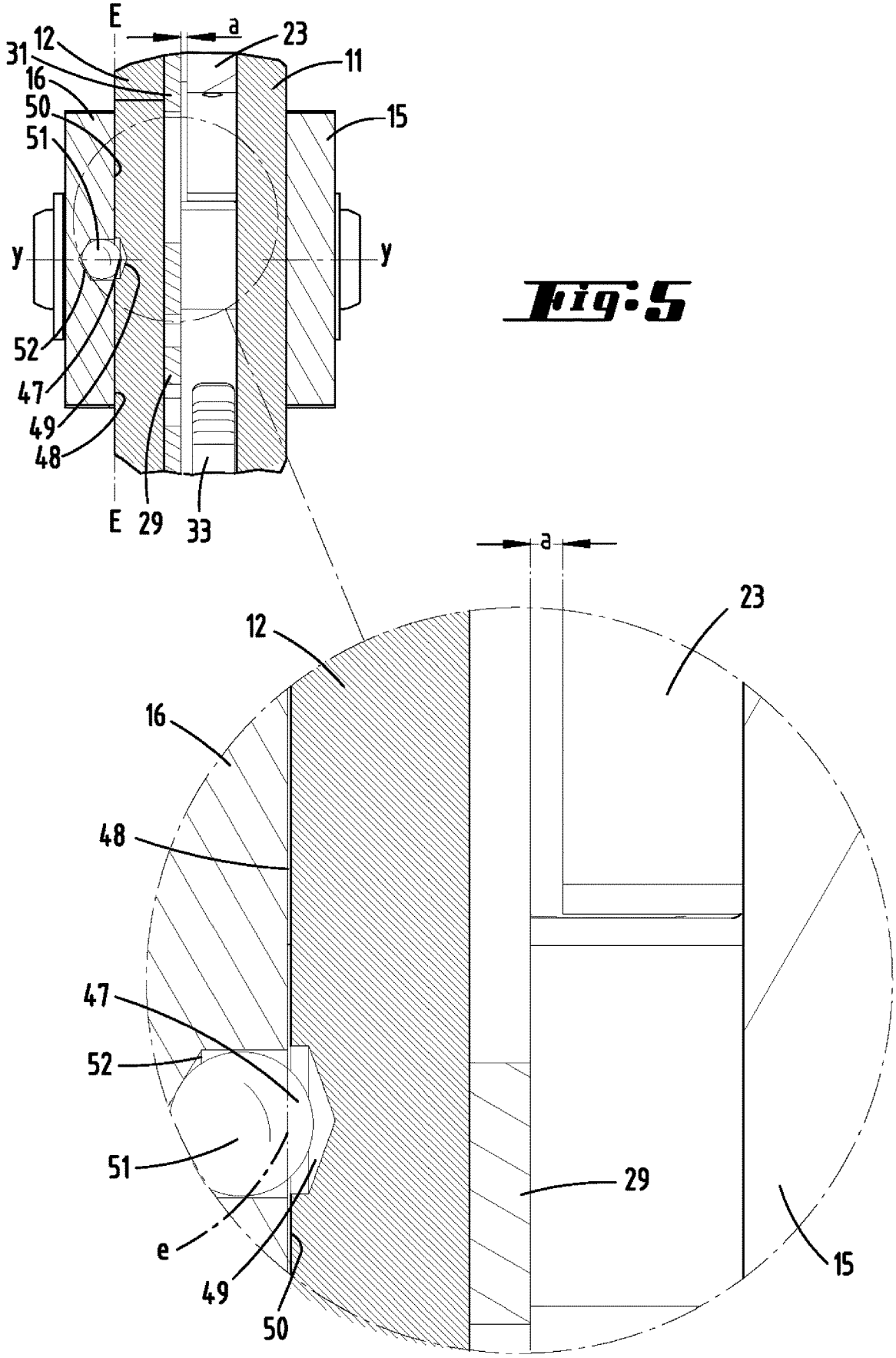
FIG. 5 the magnification with focus on area V on FIG. 4, with an additional loupe-like magnification.
Figure 6:
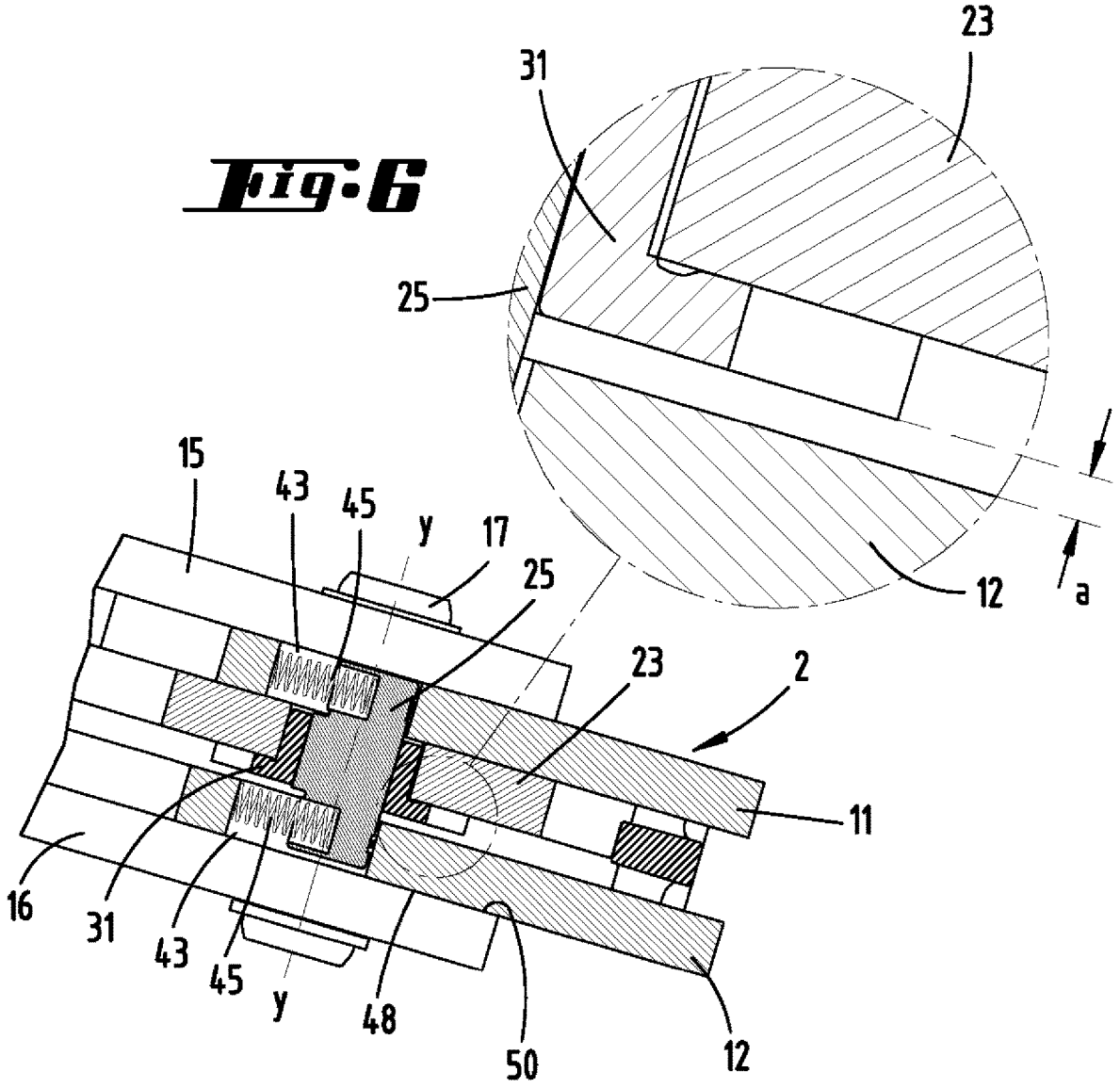
FIG. 6 the section according to line VI-VI on FIG. 3, with accompanying loupe-like magnification.

In the open position of the crimping jaws, for example as depicted on FIG. 5, the elevation 47 passes through an imagined elongated extension e of the surface 50 surrounding the recess 49 inside of the recess 49.

In this position, the axial gap size (distance a) arises in the area between the facing interior surfaces of the allocated jaw plates of a crimping jaw 2, 3. The crimping die 23 or 24 can be rotated to set a correct crimping depression 27, 28.

Figure 9:
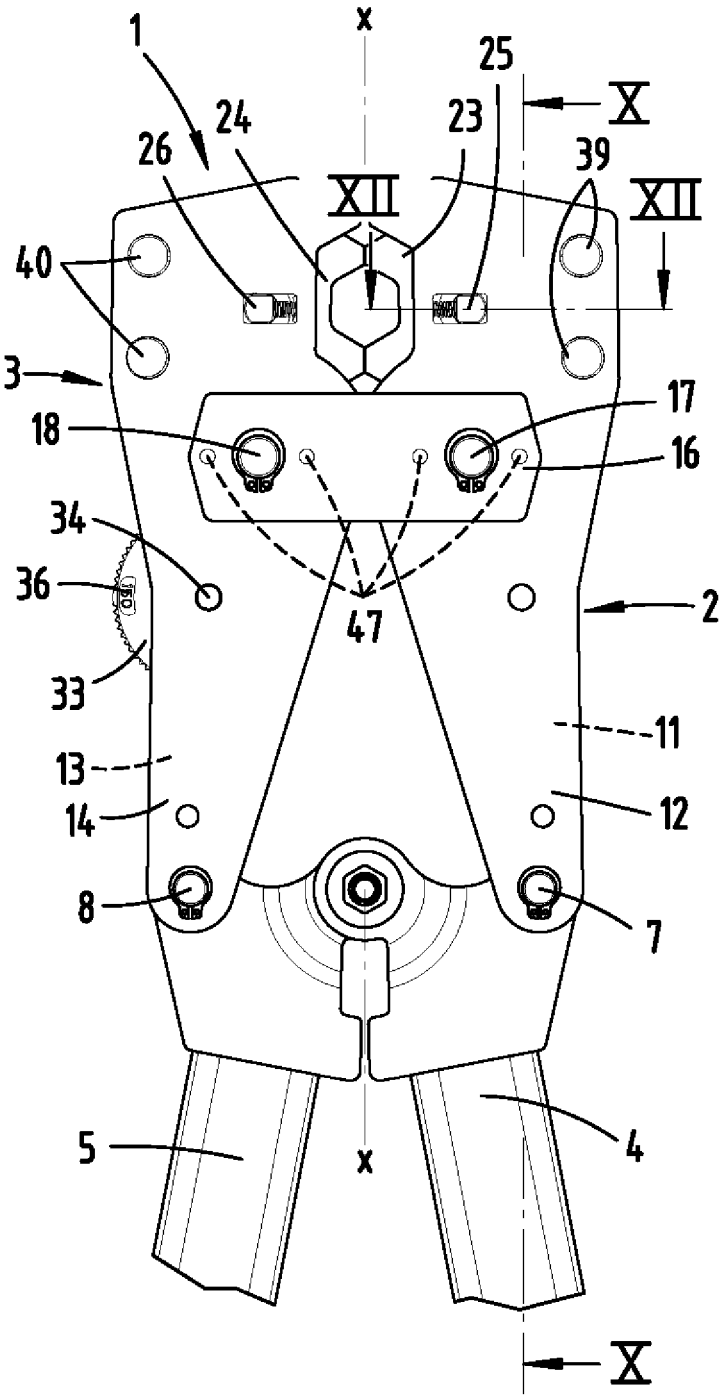
FIG. 9 an illustration essentially corresponding to FIG. 3, but crimping jaw in the closed position.
Figure 10:
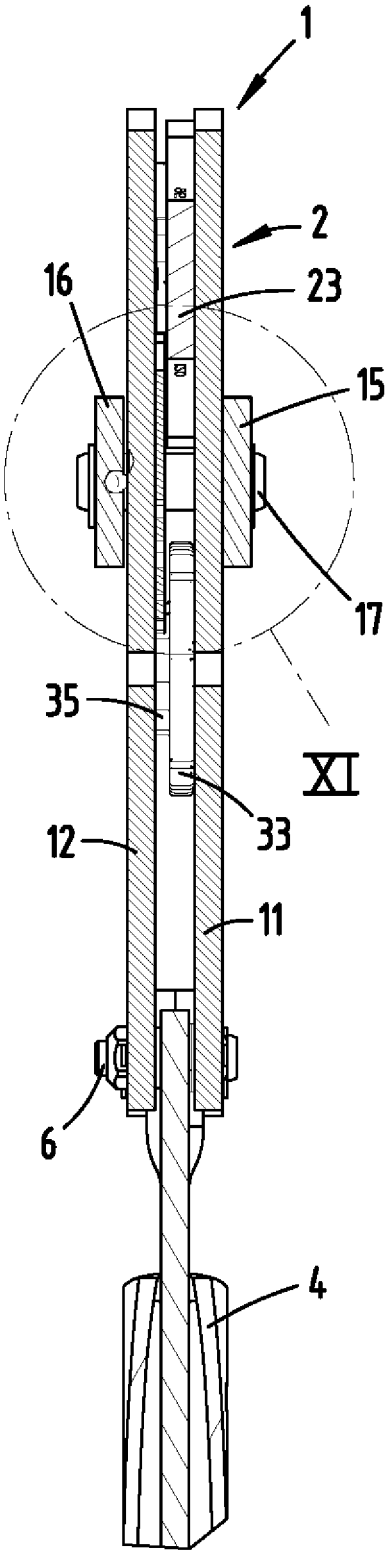
FIG. 10 the section according to line X-X on FIG. 9.

During a crimping process, the crimping jaws 2 and 3 are pivoted out of the open position of the crimping pliers into a crimping position of the crimping pliers according to the illustration on FIG. 9. This simultaneously induces a pivoting displacement of the jaw plate-side recesses 49, during which the connection piece-side elevations 47 exit. As the elevations 47 are supported on the facing surface 50 of the jaw plate 12 or 14, this is accompanied by an elastic deformation of the jaw plate in the direction toward the opposing jaw plate of the same crimping jaw 2, 3. The respective jaw plate 12 or 14 is here deformed in the direction of the rotational axis y by the measure of the elevation, correspondingly at least approximately by the measure of distance a, in such a way that the axial play of the crimping die is lifted given a corresponding clamping of the crimping die and allocated output wheel between the jaw plates of a crimping jaw 2, 3.

In the crimping position of the crimping pliers, the crimping dies 23 and 24 are aligned flush with each other due to the lifting of the axial play given in the open position.

At least one elevation 47 and one recess 49 can be provided, allocated to each jaw plate 12 and 14. In addition, a plurality of elevations and recesses can also produce the desired clamping.

In the embodiments shown, two elevations 47 arranged diametrically opposite each other in relation to the rotational axis y are formed on the connection piece 16 per jaw plate 12 or 14, to which are allocated correspondingly positioned recesses 49 in the jaw plates 12 or 14. In this way, four such elevations 47 can be provided on the inside, i.e., allocated to the surface 48 of the connection piece, which are arranged along a geometric line that runs in the longitudinal extension of the connection piece 16 and transverse to the rotational axis y, wherein the geometric line further preferably intersects the geometric rotational axis y of both axes 25, 26.

Figure 14:
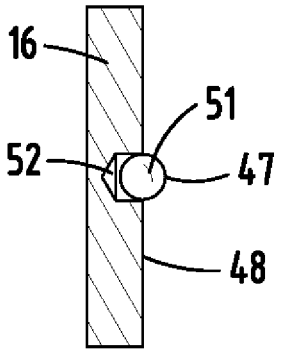
FIG. 14 the section according to sectional area XIV on FIG. 13.

According to the embodiment shown on FIGS. 1 to 14, the elevation 47 can be formed by a ball 51 captured in the connection piece 16. It can be inserted in a corresponding pan-like receptacle 52 of the connection piece 16 (see FIG. 14), wherein the depth of this receptacle 52 as viewed perpendicular to the plane of the surface 48 is further selected in such a way that the ball 51 protrudes over the surface 48 by a measure viewed perpendicular to the surface 48, wherein the extent of this protrusion essentially corresponds to the axial play (clearance a) of the crimping die.

Figure 15:
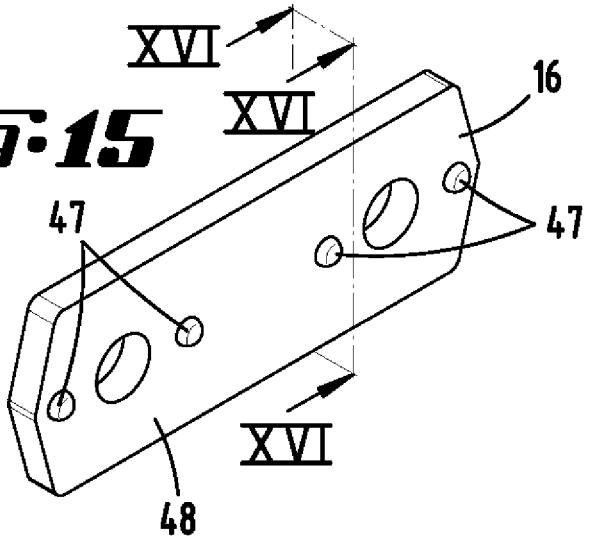
FIG. 15 a view essentially corresponding to FIG. 13, involving an alternative embodiment.
Figure 16:
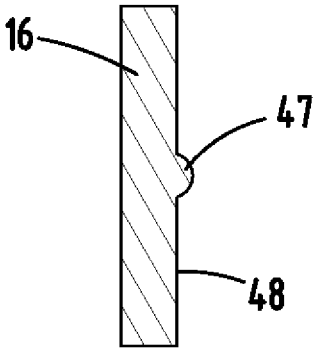
FIG. 16 the section according to sectional area XVI on FIG. 15.

According to the illustration on FIGS. 15 and 16, the elevation 47 can also be an integral part of the connection piece 16, for example, and further be the result of an integrally designed rise protruding over the surface 48, for example. The latter can further have a circular disk-shaped design in a cross section in which the rotational axis y is represented as a line (see FIG. 16).

Figure 20:
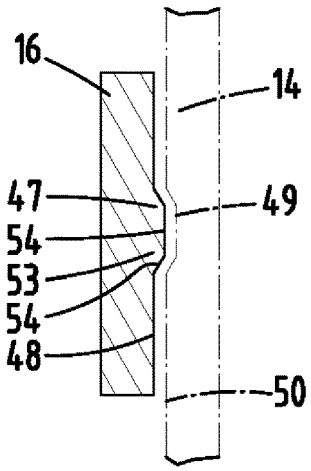
FIG. 20 a sectional view according to FIG. 19, involving an additional embodiment.
Figure 19:
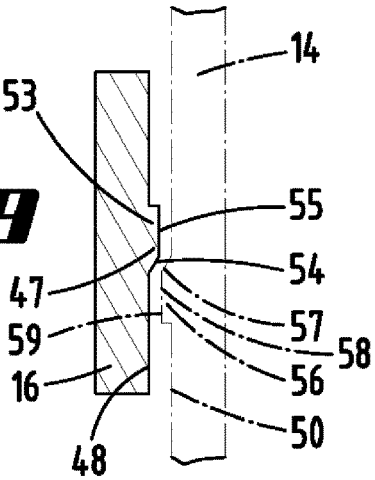
FIG. 19 the section according to sectional area XIX on FIG. 18.

The elevation 47 according to the sectional views on FIGS. 19 and 20 can also be formed by a wedge formation 53 protruding over the surface 48, having a run-on bevel 54, which starting from the surface 48 transitions into a contact surface 55 that runs parallel to the surface 48 and is spaced perpendicularly apart from the surface 48.

The wedge formation 53 can plunge into a correspondingly adjusted recess 49, for example of the jaw plate 12 or 14 (see FIG. 20). The operating principle corresponds to the operating principle described above with respect to a spherical elevation 47.

Figure 17:
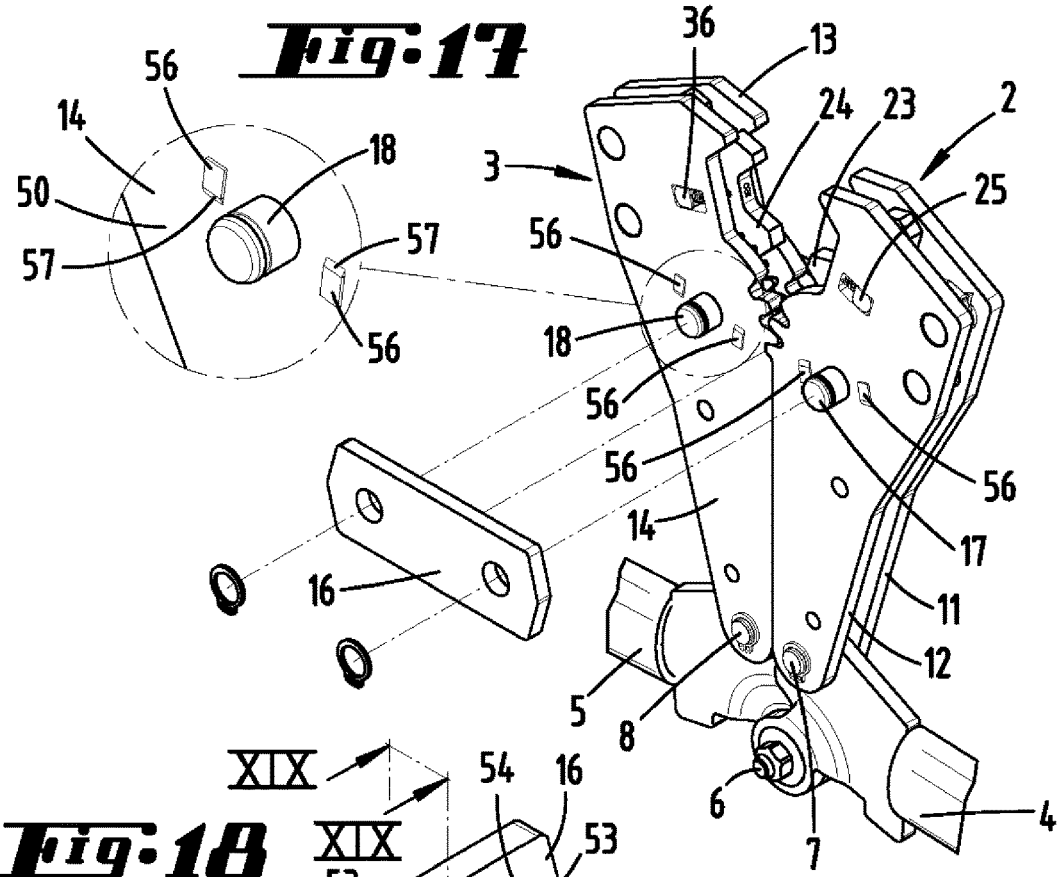
FIG. 17 a partially exploded perspective view essentially corresponding to FIG. 7, involving an additional embodiment, with accompanying loupe-like magnified view.
Figure 18:
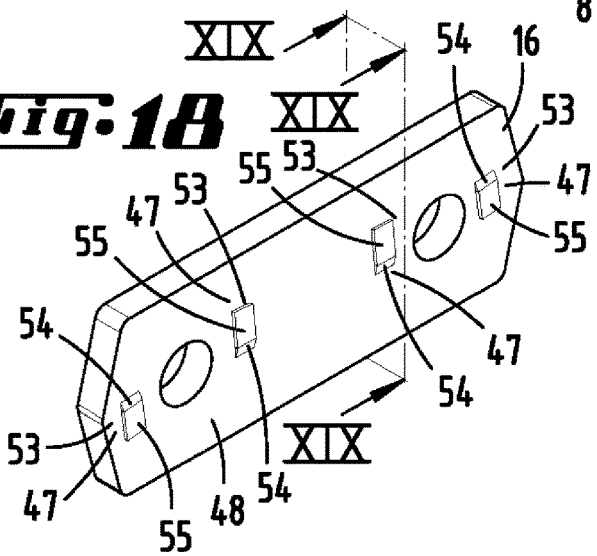
FIG. 18 a perspective view of a connection piece essentially corresponding to FIG. 13 in an embodiment according to FIG. 17.

According to the illustrations on FIGS. 17 to 19, an elevation 58 protruding on the jaw plate side over the respective surface 50 can also be provided, for example in the form of a counter-wedge formation 56, which can abut against the run-on bevel 54 of the wedge formation 53 with a run-on bevel 57 in the open position or release position of the crimping pliers. In this release position, the contact surface 55 of the elevation 47 or the contact surface 59 of the elevation 58 passes through the elevation of the other side, as viewed in the rotational direction of the crimping jaw.

An interaction between two wedge formations on the jaw plate and connection piece leads to an elevation of the respective formation relative to the allocated surface 48 or 50 that measures essentially about half the axial play, i.e., about half the clearance a.

Even given a wedge formation 53, the contact surface 55 acts on the jaw plate 12 or 14 for purposes of elastic deformation in the crimping position (clamping position) of the crimping pliers, either directly by way of its surface 50 given a formation according to FIG. 20, or by way of the facing contact surface of the counter-wedge formation 56 given a configuration according to FIGS. 17 to 19.

The rotational displacement of the crimping dies 23, 24 is synchronized. This is achieved via a continuous gearbox coupling of the crimping dies 23, 24, wherein this coupling is independent of the pivoting position of the crimping jaws 2, 3.

In the embodiment shown, a gearwheel 29, 30 in the form of a toothed wheel is rotatably arranged on each crimping jaw 2 for the gearbox coupling.

In the embodiment shown, the gearwheels 29, 30 have an elastically flexible design. To this end, the gearing teeth of each gearwheel 29, 30 are divided into groups, for example each with four sequential gearing teeth in the circumferential direction.

The gearing teeth in a group are formed on a mounting part. A spring-loadable branch proceeds from the latter as a single, integral piece, and is bound to a radially inner area of the gearwheel 29, 30 also designed as a single, integral piece.

The configuration of the gearwheel 29, 30 described above allows for an elastic resiliency for an engaged group of gearing teeth, even given a central, in particular strictly radial exposure, wherein an elastic effect can be achieved in both a radial direction and a circumferential direction.

As was the case with the crimping dies 23, 24, the gearwheels 29, 30 also extend into the free clearance space between the jaw plates of the crimping jaws 2, 3.

The gearwheels 29, 30 are rotatably mounted on the axle bolts 17, 18, wherein the toothed wheel-shaped gearwheels 29, 30 mesh with each other. The selected arrangement of the gearwheels 29, 30 on the axle bolts 17, 18 ensures the meshing engagement relative to each other in each pivoting position of the crimping jaws 2, 3.

The outer diameter of each gearwheel 29, 30 essentially corresponds to roughly the diameter of a circle line that connects the radial tips of the crimping dies 23, 24.

Provided on the axes 25, 26 are output wheels 31, 32, which are non-rotatably connected with the respective crimping die 23, 24. As shown, the output wheels 31, 32 can be teeth that mesh with the respectively allocated gearwheel 29, 39.

The diameter of the output wheel 31, 32 is diminished relative to the diameter of the gearwheel 29, 30. An output wheel 31, 32 has an outer diameter that corresponds to roughly 0.4 to 0.5 times the outer diameter of a gearwheel 29, 30.

The diameter of an output wheel 31, 32 is further selected in such a way that it does not protrude into the crimping depressions 27 or 28 of the allocated crimping die 23, 24 with respect to a projection along the rotational axis y.

An adjusting wheel 33 can further be provided on a crimping jaw 3. In the area of the rear, longer lever arm 22, it is rotatably mounted with a rotational axis z around an axle bolt 34 that passes through the accompanying jaw plates 13, 14. The adjusting wheel 33 is shaped like a circular disk, with a circular disk surface that extends in a planarly offset manner parallel to the broad surfaces of the gearwheels 29, 30 and the crimping dies 23, 24.

A driving wheel 35 in the form of a toothed wheel is provided, allocated to a disk surface of the adjusting wheel 33, and non-rotatably arranged thereon and coaxially thereto. It meshes with the external teeth of the allocated gearwheel 30 of the crimping jaw 3.

The arrangement of the axle bolt 34 is here preferably selected in such a way that the adjusting wheel 33 projects freely with a partial section outwardly over the layout contour of the crimping jaw 3, i.e., facing away from the opposing crimping jaw 2, so as to operate the driving wheel 35 by hand. In this way, for example, the driving wheel 35 can be thumb activated, in that the thumb surface rotationally displaces the adjusting wheel 33 via its circumferential edge.

Rotationally displacing the adjusting wheel 33 leads to a synchronous rotational displacement of the crimping dies 23, 24 via the gearbox comprised of the driving wheel 35, gearwheels 29, 30 and output wheels 31, 32, so that just displacing only one part (adjusting wheel 33) always makes it possible to move the same crimping depressions 27, 28 into the working position, one opposite the other.

The circular disk surface of the adjusting wheel 33 can have applied to it characters 36 in the form of numbers, which correspond to the nominal widths of the crimping depressions 27 and 28. The characters 36 are arranged on a circle line around the geometric axis of the axle bolt 34, such that the crimping depressions 27, 28 in the nominal width that reflects the working position are discernible to the user, for example on the section of the adjusting wheel 33 protruding over the layout of the crimping jaw 3.

The adjusting wheel 33 is not exposed to any pressing force in the crimping process. A material other than that of the crimping dies 23, 24 is preferably selected for the adjusting wheel 33, e.g., zinc die cast, which makes it easier to apply the characters 36, for example by pressing on or embedding the characters 36 during the casting process.

The respective working position of the crimping dies 23, 24 can be secured by positive locking. To this end, a bracket-like positive locking means 37, 38 can be allocated to each crimping die 23, 24. The positive locking means 37, 38 extend in the space between the allocated jaw plates of the crimping jaws 2, 3, and are mounted in the jaw plates via pin-like extensions 39, 40.

The positive locking means 37, 38 are arranged facing away from the crimping depression 27, 28, which is in the working position.

Viewed in the circumferential direction of each crimping die 23, 24, a tooth-like projection 41, 42 aligned essentially radially with respect to the geometric rotational axis y of the crimping die 23, 24 extends between two adjacent crimping depressions 27, 28.

Each projection 41, 42 has two impact surfaces that include an obtuse angle relative to each other in the layout. The impact surfaces yield a roof-shaped point thinning of each projection 41, 42.

The impact surfaces of the projections 41, 42 that border the crimping depression lying opposite the crimping depression 27, 28 located in the working position interact with adjusted positive locking surfaces of the positive locking means 37, 38.

The crimping dies 23, 24 are secured against rotation in the positive locking position, for example according to the illustration on FIG. 2. In order to turn the crimping dies 23, 24, the positive lock must first be lifted. This takes place accompanied by the rotary action on the crimping die 23, 24, in particular by the gearbox-transmitted action manually initiated via the adjusting wheel 33.

The axes 25, 26 of the crimping dies 23, 24 are guided in oblong holes 43, 44 of the crimping jaws 2, 3 aligned transverse to the alignment of the positive locking surfaces with reference to a layout. As a result, the crimping dies 23, 24 can be displaced transverse to the positive locking means 37, 38 in order to lift the positive lock.

Such a displacement takes place against the force of a spring 45, 46. The latter can be a cylinder compression spring.

The spring force always acts in the direction toward the positive locking position, independently of the pivoting position of the crimping jaws 2, 3.

In order to adjust the crimping dies 23, 24, the disk-like adjusting wheel 33 is turned. This causes the two gearwheels 29, 30 to turn in the opposite direction.

The output wheels 31, 32 and correspondingly the crimping dies 23, 24 are in turn rotationally displaced in the opposite direction via the gearwheels 29, 30, which leads to a forced transverse displacement of the crimping dies 23, 24 as the impact surfaces slide on the allocated positive locking surfaces. This transverse displacement is superposed by the rotational displacement of the crimping die 23, 24.

The nominal width of the crimping depression 27, 28 located in the working position can be read on the adjusting wheel 33.

The crimping dies 23, 24 can also be adjusted with the crimping jaws 2, 3 open by directly detecting one of the crimping dies 23 or 24 (possibly while omitting the disk-like adjusting wheel 33). The movement of the one crimping die 23 leads to the synchronous movement of the other crimping die 24 or 23 via the provided gearbox.

The above statements serve to explain the inventions encompassed by the application as a whole, which each also independently further develop the prior art by the following feature combinations, wherein two, several or all of these feature combinations can also be combined, specifically:

Crimping pliers, characterized in that the crimping dies can be moved relative to the jaw plates 11, 12, 13, 14 into a clamping position and a release position with the crimping pliers assembled ready for use.

Crimping pliers, characterized in that the jaw plates 11 and 13 or 12 and 14 of the opposing crimping jaws 2, 3 interact with a shared connection piece 15, 16.

Crimping pliers, characterized in that the clamping position can be generated by a relative movement between the connection piece 15, 16 and the jaw plate 11, 12, 13, 14.

Crimping pliers, characterized in that one of the parts, the connection piece 15, 16 or the jaw plate 11, 12, 13, 14, has an elevation 47, and the other part has a recess 49, wherein a surface 50 is formed outside of the recess 49 whose imagined elongated extension e is passed through by the elevation 47 in the area of the recess 49 in the release position.

Crimping pliers, characterized in that both parts, the connection piece 15, 16 and the jaw plate 11, 12, 13, 14, have an elevation 48, 58, and that a surface 55, 59 that touches the first elevation 48, 58 and runs parallel to a pivoting plane E of the parts passes through the other elevation 48, 58 in the release position.

Crimping pliers, characterized in that, in the clamping position, the elevation 47 has completed a relative movement in the direction toward the imagined elongated extension e of the surface 50 in the area of the recess 49 or beyond that.

Crimping pliers, characterized in that the elevation 47 is spherical in design in a cross section in which the rotational axis y is represented as a line.

Crimping pliers, characterized in that the elevation 47 is formed by a ball captured on the respective part.

Crimping pliers, characterized in that the elevation 47 is wedge-shaped in a cross section.

All disclosed features (taken separately or in combination with each other) are essential to the invention. The disclosure of the application hereby also incorporates the disclosure content of the accompanying/attached priority documents (copy of preliminary application) in its entirety, also for the purpose of also including features in these documents in claims of the present application. Even without the features of a referenced claim, the subclaims characterize independent inventive further developments of prior art with their features, in particular so as to initiate partial applications based on these claims. The invention indicated in each claim can additionally have one or several of the features indicated in the above specification, in particular those provided with reference numbers and/or included on the reference list. The invention also refers to embodiments in which individual features mentioned in the above specification are not realized, in particular to the extent they are obviously unnecessary for the respective intended application, or can be replaced by other technically equivalent means.

| Reference List | |
|---|---|
| 1 | Crimping pliers |
| 2 | Crimping pliers |
| 3 | Crimping pliers |
| 4 | Handle |
| 5 | Handle |
| 6 | Joint pin |
| 7 | Bolt |
| 8 | Bolt |
| 9 | Spring ring |
| 10 | Spring ring |
| 11 | Jaw plate |
| 12 | Jaw plate |
| 13 | Jaw plate |
| 14 | Jaw plate |
| 15 | Piece |
| 16 | Piece |
| 17 | Axle bolt |
| 18 | Axle bolt |
| 19 | Lever arm |
| 20 | Lever arm |
| 21 | Lever arm |
| 22 | Lever arm |
| 23 | Crimping die |
| 24 | Crimping die |
| 25 | Axis |
| 26 | Axis |
| 27 | Crimping depression |
| 28 | Crimping depression |
| 29 | Gearwheel |
| 30 | Gearwheel |
| 31 | Output wheel |
| 32 | Output wheel |
| 33 | Adjusting wheel |

-continued

| Reference List | |
|---|---|
| 34 | Axle bolt |
| 35 | Driving wheel |
| 36 | Character |
| 37 | Positive locking means |
| 38 | Positive locking means |
| 39 | Extension |
| 40 | Extension |
| 41 | Projection |
| 42 | Projection |
| 43 | Oblong hole |
| 44 | Oblong hole |
| 45 | Spring |
| 46 | Spring |
| 47 | Elevation |
| 48 | Surface |
| 49 | Recess |
| 50 | Surface |
| 51 | Ball |
| 52 | Receptacle |
| 53 | Wedge formation |
| 54 | Run-on bevel |
| 55 | Contact surface |
| 56 | Counter-wedge formation |
| 57 | Run-on bevel |
| 58 | Elevation |
| 59 | Contact surface |
| a | Distance |
| b | Elongated extension |
| x | Axis |
| y | Axis |
| z | Axis |
| E | Pivoting plane |

The invention claimed is:

1. Crimping pliers configured to press cable shoes onto electrical conductors, comprising:

two crimping jaws that can be pivoted toward one another into a crimping position;

a crimping die rotatably mounted in each crimping jaw, each crimping die including multiple different crimping depressions over a circumference of the crimping die in relation to a rotational axis of the crimping die, each crimping die is held between two jaw plates of each crimping jaw in relation to the rotational axis of the crimping dies;

wherein the crimping dies can be moved relative to the jaw plates in a direction of the rotational axis of the crimping dies into a clamping position that prevents rotation of the crimping dies relative to the jaw plates and a release position that enables an adjustment of the crimping dies relative to the crimping jaws; and wherein clamping the crimping dies in the clamping position results in the crimping dies being fixed relative to the jaw plates in the direction of the rotational axis and the clamping the crimping dies in the clamping position is generated automatically during a pivoting displacement of the crimping jaws in the direction toward the crimping position, and lifted given an opposite pivoting displacement of the crimping jaws away from the crimping position.

2. The crimping pliers according to claim 1, wherein the jaw plates interact with a shared connection piece.

3. The crimping pliers according to claim 2, wherein one of the connection piece or the jaw plates has an elevation, and the other of the connection piece or the jaw plates has a recess; and wherein a surface is formed outside of the recess having imagined elongated extension that is passed through by the elevation in the area of the recess in the release position.

4. The crimping pliers according to claim 3, wherein, in the clamping position, the elevation has completed a relative movement in the direction toward the imagined elongated extension of the surface in the area of the recess or beyond that.

5. The crimping pliers according to claim 3, wherein in that the elevation is spherical.

6. The crimping pliers according to claim 3, wherein the elevation is formed by a ball captured on the respective connection piece or the jaw plates.

7. The crimping pliers according to claim 3, wherein that the elevation is wedge-shaped in a cross section.

8. The crimping pliers according to claim 2, wherein the clamping position can be generated by a relative movement between the connection piece and the jaw plates.

9. The crimping pliers according to claim 8, wherein one of the connection piece or the jaw plates has an elevation, and the other of the connection piece or the jaw plates has a recess; and wherein a surface is formed outside of the recess having imagined elongated extension that is passed through by the elevation in the area of the recess in the release position.

10. The crimping pliers according to claim 9, wherein, in the clamping position, the elevation has completed a relative movement in the direction toward the imagined elongated extension of the surface in the area of the recess or beyond that.

11. The crimping pliers according to claim 2, wherein one of the connection piece or the jaw plates has a first elevation, and the other of the connection piece or the jaw plates has a recess;

wherein a surface is formed outside of the recess having imagined elongated extension that is passed through by the first elevation in the area of the recess in the release position; and wherein each of the connection piece and the jaw plate have a second elevation, and that a surface that touches the first elevation and runs parallel to a pivoting plane of the connection piece and the jaw plates passes through the second elevation in the release position.

12. The crimping pliers according to claim 11, wherein, in the clamping position, the first elevation has completed a relative movement in the direction toward the imagined elongated extension of the surface in the area of the recess or beyond that.

13. The crimping pliers according to claim 1, wherein one of the connection piece or the jaw plates has a first elevation, and the other of the connection piece or the jaw plates has a recess;

wherein a surface is formed outside of the recess having imagined elongated extension that is passed through by the first elevation in the area of the recess in the release position; and wherein each of the connection piece and the jaw plate have a second elevation, and that a surface that touches the first elevation and runs parallel to a pivoting plane of the connection piece and the jaw plates passes through the second elevation in the release position.

14. The crimping pliers according to claim 13, wherein, in the clamping position, the first elevation has completed a relative movement in the direction toward the imagined elongated extension of the surface in the area of the recess or beyond that.

15. Crimping pliers configured to press cable shoes onto electrical conductors, comprising:

two crimping jaws that can be pivoted toward one another into a crimping position;

a crimping die rotatably mounted in each crimping jaw, each crimping die including multiple different crimping depressions over a circumference of the crimping die in relation to a rotational axis of the crimping die;

each crimping die is held between two jaw plates of each crimping law in relation to the rotational axis of the crimping dies;

wherein the crimping dies can be moved relative to the jaw plates in a direction of the rotational axis of the crimping dies into a clamping position that prevents rotation of the crimping dies relative to the jaw plates and a release position that enables an adjustment of the crimping dies relative to the crimping jaws by a relative movement between a connection piece of the jaw plates of the crimping jaws and the jaw plates;

wherein clamping the crimping dies in the clamping position results in the crimping dies being fixed relative to the jaw plates in the direction of the rotational axis, the clamping the crimping dies in the clamping position is generated automatically during a pivoting displacement of the crimping jaws in the direction toward the crimping position, and lifted given an opposite pivoting displacement of the crimping jaws away from the crimping position.

16. The crimping pliers according to claim 15, wherein the jaw plates interact with the connection piece, and the clamping position can be generated by a relative movement between the connection piece and the jaw plates.

17. The crimping pliers according to claim 16, wherein one of the connection piece or the jaw plates has an elevation, and the other of the connection piece or the jaw plates has a recess, wherein a surface is formed outside of the recess having an imagined elongated extension which is passed through by the elevation in the area of the recess in the release position.

18. The crimping pliers according to claim 15, wherein one of the connection piece or the jaw plates has a first elevation, and the other of the connection piece or the jaw plates has a recess;

wherein a surface is formed outside of the recess having imagined elongated extension that is passed through by the first elevation in the area of the recess in the release position; and wherein each of the connection piece and the jaw plate have a second elevation, and that a surface that touches the first elevation and runs parallel to a pivoting plane of the connection piece and the jaw plates passes through the second elevation in the release position.

19. The crimping pliers according to claim 18, wherein, in the clamping position, the first elevation has completed a relative movement in the direction toward the imagined elongated extension of the surface in the area of the recess or beyond that.

* * * * *